US008522709B2

(12) United States Patent
Williams et al.

(10) Patent No.: US 8,522,709 B2
(45) Date of Patent: Sep. 3, 2013

(54) WAKEBOARD TOWER WITH SUN COVER AND SKI TOW POINT

(75) Inventors: Anthony Duane Williams, Maryville, TN (US); Robert Blaine Metcalf, Lenoir City, TN (US)

(73) Assignee: Xtreme Marine Corporation, Maryville, TN (US)

( * ) Notice: Subject to any disclaimer, the term of this patent is extended or adjusted under 35 U.S.C. 154(b) by 106 days.

(21) Appl. No.: 13/310,981

(22) Filed: Dec. 5, 2011

(65) Prior Publication Data

US 2012/0137954 A1 Jun. 7, 2012

Related U.S. Application Data

(63) Continuation-in-part of application No. 13/228,033, filed on Sep. 8, 2011.

(60) Provisional application No. 61/383,516, filed on Sep. 16, 2010.

(51) Int. Cl.
*B63B 17/00* (2006.01)

(52) U.S. Cl.
USPC ..... 114/361; 114/253

(58) Field of Classification Search
USPC ..... 114/253, 361; 135/88.01
See application file for complete search history.

(56) References Cited

U.S. PATENT DOCUMENTS

| | | | | |
|---|---|---|---|---|
| 5,918,613 | A | 7/1999 | Larson | |
| 6,257,261 | B1 | 7/2001 | Johnson | |
| 6,439,150 | B1 * | 8/2002 | Murphy et al. | 114/361 |
| 6,691,637 | B1 | 2/2004 | Smith | |
| 6,945,188 | B2 | 9/2005 | Eck | |
| 6,994,050 | B2 | 2/2006 | Johnson | |
| 7,571,691 | B2 * | 8/2009 | Russikoff | 114/361 |
| 7,895,964 | B2 * | 3/2011 | Russikoff | 114/361 |
| 2002/0053313 | A1 | 5/2002 | Murphy | |
| 2005/0186029 | A1 | 8/2005 | Jones | |
| 2007/0290016 | A1 | 12/2007 | Jesewitz | |

* cited by examiner

*Primary Examiner* — Lars A Olson
(74) *Attorney, Agent, or Firm* — Luedeka Neely Group, P.C.

(57) ABSTRACT

A sun cover for use with a boat tower having an elevated tow point. The cover includes a frame having a forward portion and a rear portion located adjacent to the forward portion, with at least a portion of the rear portion being spaced above or below the forward portion, defining a gap defined above or below a trailing portion of the forward portion and a leading portion of the rear portion. The frame is mounted to the tower and oriented relative to the tower so that the tow point is accessible via the gap such that a tow rope connected to the tow point extends rearwardly from the tow point via the gap and the cover does not interfere with a tow rope attached to the tow point during use of the boat to pull a person being towed by the boat using the tow rope.

4 Claims, 3 Drawing Sheets

WAKEBOARD TOWER WITH SUN COVER AND SKI TOW POINT

CROSS-REFERENCE TO RELATED APPLICATION

This application is a continuation-in-part of co-pending U.S. patent application Ser. No. 13/228,033 filed. Sep. 8, 2011, and entitled "Wakeboard Tower With Bimini Cover And Ski Tow Point, which claims priority to U.S. Provisional Application Ser. No. 61/383,516 filed Sep. 16, 2010, and entitled "Wakeboard Tower With Bimini Cover And Ski Tow Point," incorporated by reference herein in their entireties.

FIELD

The present disclosure relates to wakeboard towers for boats. More particularly, the disclosure relates to a top structure that can be installed onto a conventional wakeboard tower and utilized without interfering with the tow point.

BACKGROUND AND SUMMARY

The sport of wakeboarding is very similar to the sports of waterskiing, kneeboarding, and tubing. A wakeboarder or person riding a wakeboard is towed behind the boat by a rope. Typically, waterskiing, kneeboarding, and tubing use a rope secured to a stern mount on either or both sides of the motor of the boat. However, in the sport of wakeboarding, the rope is typically attached to a mount connected to a tower cross member. The mount on the tower provides a much higher connection point for the tow rope and provides vertical component force on the tow rope held by a wakeboarder thus allowing the wakeboarder to more easily perform aerial stunts and maneuvers. That is, the wakeboarding experience is improved by use of a tow point that is elevated as compared to the elevation of tow points used for waterskiing.

The provision of a tower having an elevated tow point interferes with the use of conventional bimini covers of the type used on boats having a low tow point. Attempts have been made to incorporate bimini or other sun-shielding, covers with wakeboard towers having an elevated tow point. Such covers are not integrated with the tower and are useable at times when the boat is not in use to pull a wakeboarder. However, as the covers can interfere with the elevated tow point of the wakeboard tower, they are generally unsuitable for use when the tow point is in use. This results in undesired sun exposure and other undesirable circumstances resulting from the lack of a cover while the boat is in use to pull a wakeboarder. Accordingly, what is desired is an improved sun cover that can be installed onto a conventional wakeboard tower and not interfere with the tow point.

The disclosure advantageously provides an improved sun cover for installation onto a boat tower such as a wakeboard tower having a pair of opposed legs and at least one structural member extending between upper portions of the legs and a tow point extending upwardly from the tower.

In one aspect, the sun cover includes a frame having a forward portion including an elevated central portion, and a rear portion located adjacent to and immediately behind the forward portion, with the entirety of the rear portion being spaced relative to, that is, either above or below the elevated central portion. A gap is defined relative to, that is, above or below a trailing portion of the forward portion and a leading portion of the rear portion of the frame. A mount is provided that mounts the frame to the tower and fixedly orients the frame relative to the tower so that the tow point is accessible via the gap such that a tow tope connected to the tow point extends rearwardly from the tow point via the gap and the cover does not interfere with a tow rope attached to the tow point during use of the boat to pull a person being towed by the boat using the tow rope.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
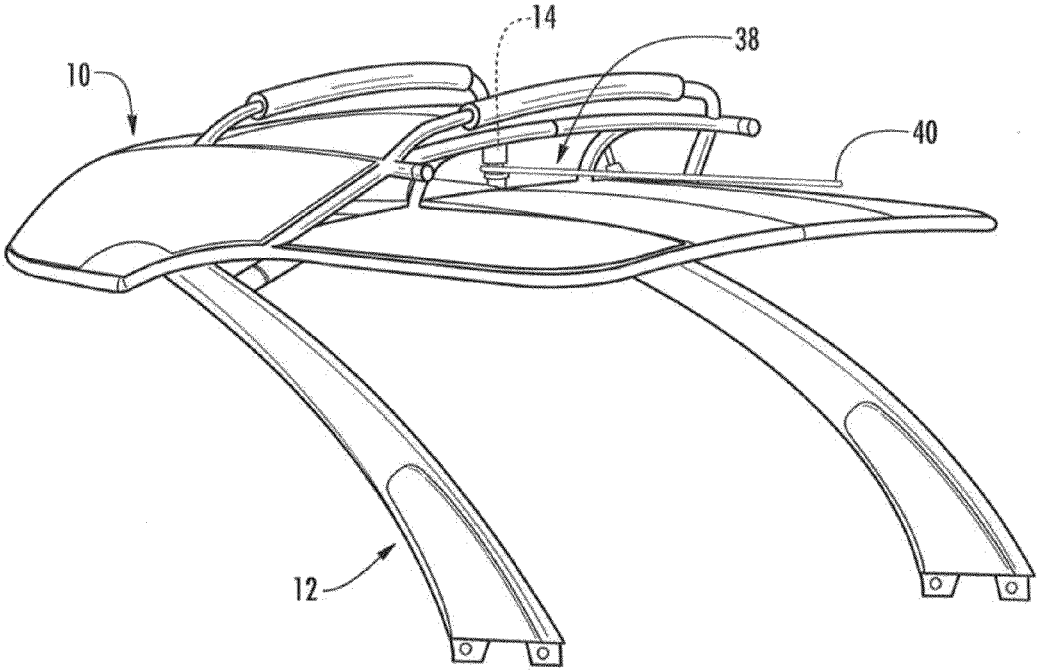
FIG. 1 is a perspective view of a sun cover according to the disclosure installed onto a wakeboard tower.
Figure 2:
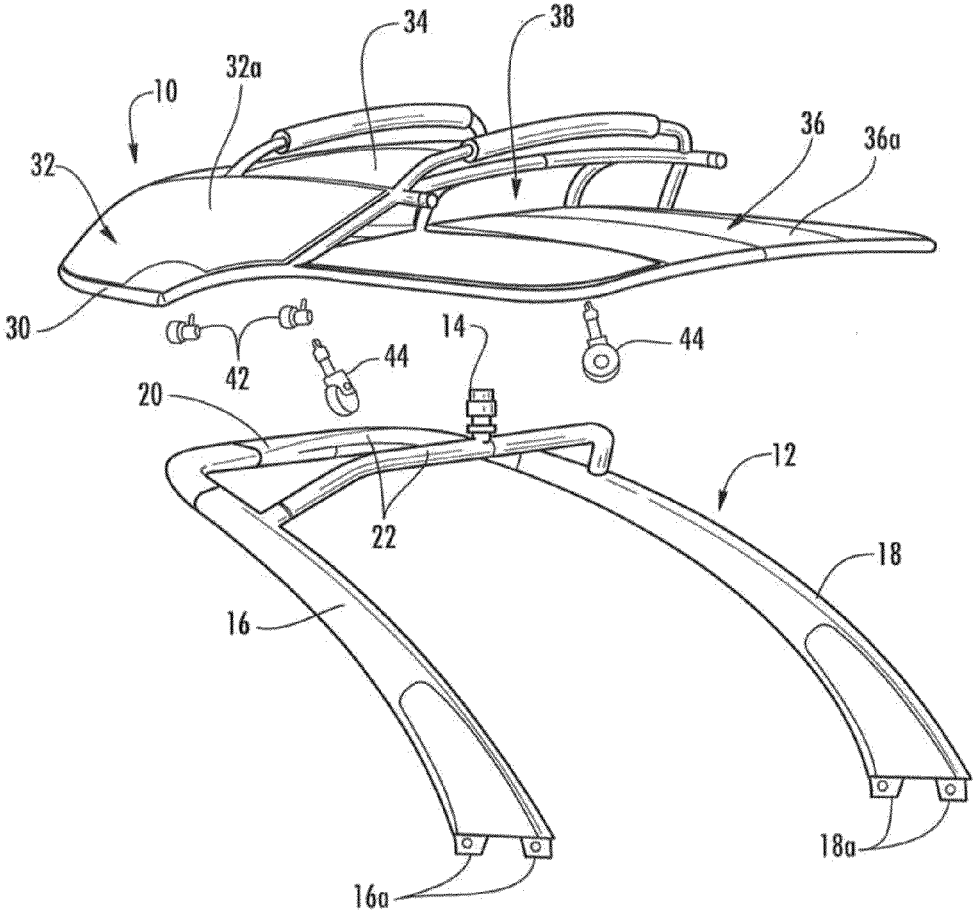
FIG. 2 is an exploded view of FIG. 1.

With reference to the drawings, there is shown a sun cover 10 for installation onto wakeboard tower 12 for a boat.

The wakeboard tower 12 has an elevated tow point 14 typically aligned with a centerline of the boat. The wakeboard tower 12 may be a conventional wakeboard tower, such as a so-called two-point tower as shown, having a generally U-shape provided by a pair of opposed legs 16 and 18 mounted to the boat as by mounts 16*a* and 18*a* on the lower ends thereof. The legs 16 and 18 are typically made of aluminum and are generally configured in the shape of an arch mountable to a boat hull so as to extend in a forward or bow direction, rising along its length. The upper ends of the legs 16 and 18 are connected by a cross-piece 20 and bracing 22. The tow point 14 is typically mounted on the cross-piece 20 or the bracing 22 at the highest point thereof.

The sun cover 10 includes a frame 30 having a forward portion 32 including an elevated central portion 34, and a rear portion 36 located adjacent to and immediately behind the forward portion 32, with the entirety of the rear portion 36 being spaced relative to, that is, above or below the elevated central portion 34.

The forward portion 32 of the frame 30 may be a concave lattice of sections of aluminum tubing welded together to provide a unitary structure. In this regard, in one embodiment, the forward portion 32 fans out from a rear edge to a wider front edge. The rear portion 36 may be a relatively planar and rectangular lattice of sections of aluminum tubing welded together. However, it will be understood that that forward portion 32 and the rear portion 36 may be configured in various shapes to provide a suitable sun cover, it being understood that the forward portion 32 and the rear portion 36 are relatively vertically spaced relative to one another, that is, with the rear portion 36 either vertically above or vertically below the forward portion 32 to enable a gap for placement of the tow point 14 as described herein.

The forward portion 32 and the rear portion 36 are joined at adjacent side portions thereof, such that the entirety of the frame 30 provides a unitary structure. However, as will be noted, a central gap 38 is defined either above or below the rear of the forward portion 32 and the front of the rear portion 36 of the frame.

The forward portion 32 and the rear portion 36 of the frame 30 are each covered with flexible fabric materials, indicated as material 32*a* and material 36*a*, respectively. The materials 32*a* and 36*a* are dimensioned to conform to the respective frame portions and may be secured to the frame portions as by straps or snap fasteners or the like to tightly and securely fit over the frame sections.

The frame 30 having the materials 32*a* and 36*a* thereon is mounted onto the tower 12 so that the tow point 14 is accessible via the gap 38 such that a tow rope 40 connected to the tow point 14 for towing a skier or wake boarder or the like extends from the tow point 14 toward the back of the boat via the gap 38. Thus, the described structure advantageously enables provision of a cover for a wakeboard tower that does not interfere with the tow point.

The frame 30 is removably mounted as by use of one or more locking pivot mounts 42 and one or more pivot mounts 44, which enable adjustment of the cover 10 for enabling use of the cover 10 onto a variety of tower sizes and configurations. For the purpose of example, the following provides an example of mounting of the cover 10 to the described tower 12.

Figure 3:
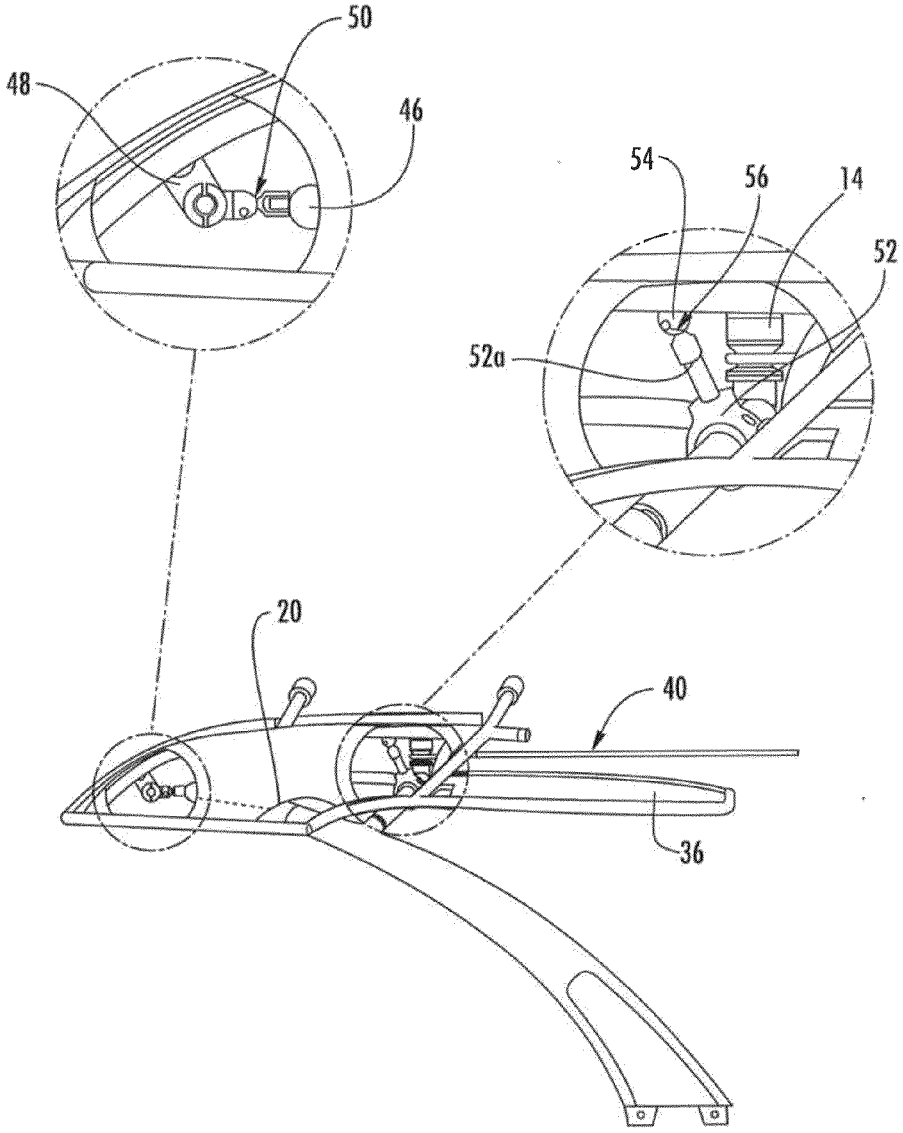
FIG. 3 shows enlargements of mounting components of the cover of FIG. 1.

With reference to FIG. 3, the lock mounts 42 include a foot 46 that is fixedly and non-movingly secured, as by fasteners, to a forward-most portion of the tower 12, such as the cross-piece 20 and oriented to extend upwardly and toward the bow of the boat. A head 48 of the lock mount 42 is secured to the forward portion 32 of the frame 30. A lockable pivot 50 connects the foot 46 and the head 48. The lockable pivot 50 includes an adjustment that enables pivotal movement of the head 48 relative to the foot 46 in an unlocked setting, but can be adjusted to a locked setting to lock the head 48 against movement relative to the foot 46. The lockable pivot 50 may be provided as by tightenable jaws extending from the foot 46 and mounted to the head 48, which enable movement except when tightened against the head 48.

The pivot mounts 44 include a sleeve 52 that pivotally mounts to a rear portion of the tower 12, such as to the bracing 22, and includes an extension 52*a*. A fixed mount 54 is secured to the forward portion 32 of the frame 30 at a location rearward of the locking pivot mount 42. A pivot 56 connects the extension 52*a* to the fixed mount 54.

To install the cover 10, the lock mounts 42 and the pivot mounts 44 are secured to the tower 12 and the frame 30 as described. Once installed, it will be appreciated that the cover 10 may be adjusted, preferably being adjusted so that the tow point 14 is located within the gap 38 such that the tow tope 40 is substantially at the vertical midpoint of the gap 38 and, when extending parallel to the rear portion 36 of the frame 30, is elevated above the rear portion 36 and below the forward portion 32 and proximate the trailing edge of the forward portion 32, preferably about vertically half-way between as depicted in FIG. 3. Once this positioning of the cover 10 relative to the tow point 14 is obtained, the lock mounts 42 may be set in the locked position to lock the position of the cover 10 relative to the tower 12 and the tow point 14. In certain embodiments, the lock mount may have a quick release mechanism by which a user can unlock the position of the cover 10 and tilt the cover in a forward and/or rearward direction about the pivot mounts to provide access to the sun cover. This may be desirable if wakeboards or other boating accessories are stored on top of the sun cover 10.

Accordingly, it will be appreciated that the sun cover 10 according to the disclosure advantageously provides a cover for use with wakeboard towers having an elevated tow point that does not interfere with the tow point. The disclosure also enables such a cover configured to enable adjustment of the position of the cover relative to the tower and removal of the cover if desired to facilitate transportation and storage of a boat equipped with the tower.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated.

The invention claimed is:

1. A sun cover for installation onto a tower of a boat, the tower having at least a pair of opposed legs and at least one structural member extending between upper portions of the legs and a tow point extending upwardly from the tower, the cover comprising:

a frame having a forward portion and a rear portion located adjacent to and behind the forward portion, with at least a portion of the rear portion being vertically spaced relative to the forward portion;

a gap defined relative to a trailing portion of the forward portion and a leading portion of the rear portion of the frame; and a mount that mounts the frame to the tower and fixedly orients the frame relative to the tower so that the tow point is accessible via the gap such that a tow rope connected to the tow point extends rearwardly from the tow point via the gap and the cover does not interfere with a tow rope attached to the tow point during use of the boat to pull a person being towed by the boat using the tow rope.

2. The sun cover of claim 1, wherein the mount comprises a lockable pivot mount.

3. The sun cover of claim 1, wherein the cover includes a covering material located on the frame.

4. The sun cover of claim 1, wherein the entirety of the rear portion is spaced below an elevated central portion of the forward portion.

* * * * *